US006235235B1

(12) United States Patent
Checketts

(10) Patent No.: US 6,235,235 B1
(45) Date of Patent: May 22, 2001

(54) SYSTEM FOR EXTRACTING SODIUM METAL FROM SODIUM HYDROXIDE AND A REDUCTANT OF NATURAL GAS

(76) Inventor: Jed H. Checketts, 2095 W. 2200 South, Salt Lake City, UT (US) 84119

( * ) Notice: Subject to any disclaimer, the term of this patent is extended or adjusted under 35 U.S.C. 154(b) by 0 days.

(21) Appl. No.: 09/262,876

(22) Filed: Mar. 5, 1999

(51) Int. Cl.[7] ..... C22B 26/10; F27B 5/16

(52) U.S. Cl. ..... 266/153; 266/161; 266/171; 122/32; 122/34; 432/200

(58) Field of Search ..... 266/153, 161, 266/171; 432/200; 75/590; 122/32, 34

(56) References Cited

U.S. PATENT DOCUMENTS

| | | | | |
|---|---|---|---|---|
| 342,897 | | 6/1886 | Castner | 75/590 |
| 380,775 | | 4/1888 | Thowless | 75/590 |
| 380,776 | | 4/1888 | Thowless | 266/153 |
| 460,985 | | 10/1891 | Netto | 75/590 |
| 2,391,728 | * | 12/1945 | McConica et al. | 75/590 |
| 2,484,266 | | 10/1949 | Bowe | 75/363 |
| 2,642,347 | | 6/1953 | Gilbert | 48/216 |
| 2,685,346 | | 8/1954 | Deyrup et al. | 420/570 |
| 2,685,505 | | 8/1954 | Deyrup | 223/102 |
| 2,774,663 | * | 12/1956 | Kirk | 75/590 |
| 2,930,689 | | 3/1960 | McGriff | 75/590 |
| 3,759,703 | * | 9/1973 | Chong | 75/590 |
| 3,823,014 | * | 7/1974 | Chong | 75/590 |

FOREIGN PATENT DOCUMENTS 603825 12/1924 (FR) .

OTHER PUBLICATIONS

Perry and Chilton, Chemical Engineers Handbook, 5th edition 1973 p. 11–3 and 11–22.*

* cited by examiner

*Primary Examiner*—Roy King
*Assistant Examiner*—Tima McGuthry-Banks
(74) *Attorney, Agent, or Firm*—M. Reid Russell

(57) ABSTRACT

An apparatus and system for its use for a continuous production on an alkali metal, preferably sodium metal, by a reduction of the metal hydroxide with methane or natural gas as a reductant. The invention is preferably utilized with sodium hydroxide as is produced as chemical waste from a chemical process and is practiced at relatively low heat, in a single or pair of interconnected reactor vessels, with sodium hydroxide and methane heated in a molten sodium carbonate bath that is maintained in the reactor vessel or vessels at a heat that is sufficient to vaporize sodium metal, along with carbon monoxide and hydrogen gases from an inlet mixture of sodium hydroxide and methane gas, with the vaporization taking place in an inert atmosphere, with the vaporized sodium metal with carbon monoxide and hydrogen gases passed to a quench cooler that is operated in an inert atmosphere at less than atmospheric pressure to condense sodium metal out of the vaporous and gaseous mix that then falls to the quench cooler bottom and is drawn therefrom, and with the off carbon monoxide and hydrogen gases to be recycled as useful burner gases to augment an inlet flow of a burning gas, such as methane, and are burned together to provide reactor heating.

17 Claims, 3 Drawing Sheets

SYSTEM FOR EXTRACTING SODIUM METAL FROM SODIUM HYDROXIDE AND A REDUCTANT OF NATURAL GAS

BACKGROUND OF THE INVENTION

1. Field of the Invention

Apparatus and process for practice therein for reduction of sodium hydroxide with natural gas in the presence of heat to produce sodium metal as a product of the thermodynamic reaction.

2. Prior Art

The invention is in a reactor vessel wherein sodium hydroxide is introduced in liquid form and reacted with natural gas or methane gas at temperatures between one thousand and eleven hundred degrees C., in a bath of sodium carbonate, with the reactants vaporized and then separated or reduced by a rapid cooling with their passage onto a cooled surface located within a quench cooler or by an introduction of a coolant liquid flow, such as mineral oil, into the gaseous reactants, to condense liquid sodium out of a vapor phase. Liquid sodium as is produced is then drained from the reactor vessel, in a continuous process. The reactor vessel and quench cooler are maintained with an inert atmosphere and the quench cooler is maintained at a pressure that is less than atmospheric, minimizing an unwanted reverse or back reaction of sodium from its metal state due to a scarcity of unreacted molecules such as are present when sodium metal is liquified in prior art quench systems.

Apparatus and processes for refining sodium metal are old in the art. Some examples of earlier apparatus and processes are shown in U. S. Pat. No 342,897 to Castner; U.S. Pat. Nos. 380,775 and 380,776 to Thowless; and U.S. Pat. No. 460,985 to Netto, that generally have involved a carbonaceous material as a reactive agent, that is usually carbon or coke in powder form, and is intended to react with a compound containing sodium or potassium, in the presence of high heat, to produce free sodium. Such processes not only require that a number of complex steps be performed to finally produce sodium metal and further they are generally single batch processes only. Whereas, the system and process of the invention provide for a continuous refinement of sodium metal from a mix of sodium hydroxide as a reactant and, preferably, natural gas as a reductant, with the invention utilizing a flow through system where the reactants are heated by a molten sodium carbon bath with, on further exposure to heat they are then vaporized. That vapor is then rapidly cooled or quenched in a quench cooler, condensing sodium metal that can then be drawn off, with the process steps taking place as a continuous process.

In a French Patent No. 603,825, sodium metal is set out as produced utilizing sodium hydroxide and iron in power form by first vaporizing the mix with the temperature of the mix then lowered to below the sodium vaporization temperature, condensing sodium metal therefrom. This process, however, must be conducted in a vacuum and requires removal of the sodium from a reaction zone to condense it. Further, the French '825 patent is like a U. S. Pat. No. 2,642,347 to Gilbert, that provides for a production of sodium metal vapor from a condensation of sodium carbonate that has been reacted with carbon at high heat of from 1000 degrees C. to 1200 degrees C., with the sodium metal vapor then conducted away from the reaction. The condensation step set out in the Gilbert '347 patent utilizes surfaces of steel balls that are individually maintained at a temperature below that required for sodium vaporization so as to condense sodium metal out of the vaporized reactants as a film on the individual ball surfaces that then must be removed, providing a batch process only. The above cited systems are each essentially batch systems only unlike the present invention that is a continuous system with sodium metal produced in liquid form that is then drawn from a quench cooler of the reaction system. Further, unlike the invention, none of the above cited patents, no the patents cited below have involved a use of sodium hydroxide and methane as reactants for a continuous system. Nor have either of the systems of these French '825 and U.S. '347 patents proved a novel reactor vessel and quench cooler configuration like that of the invention where the sodium compound is vaporized and then condensed as sodium metal at either a condensation plate that is maintained at a temperature below the temperature where a vaporized sodium metal will liquify, or by a counter current flow of a non-reactive liquid, such as mineral oil, providing for quenching sodium metal from the gaseous product from the reactor vessel, with the condensed sodium metal then drained from system into a separate vessel.

A U. S. Pat. No. 2,930,689 to McGriff teaches a submerged combustion of methane in molten sodium carbonate solution and includes a separation wall to prevent the combustion gasses, water and carbon dioxide, from entering into the reaction of methane or carbon with sodium carbonate. The McGriff process requires a high operating temperature of from 1150 to 1250 degrees C., with carbon or methane fed into the hot sodium carbonate, and with sodium carbonate continuously added. The sodium carbonate, like the invention, providing a heat sink but, unlike the invention, also provides for a reduction of the sodium carbonate with a continuous addition of carbon, preferably coke in powdered form, to perpetuate the reaction. The McGriff '689 utilizes a rectangular reactor vessel that employs a baffle as a separator and is precluded by its constriction from effectively utilizing an electrical heating strategy may be incorporated in the invention.

While McGriff '689, like the invention, teaches a use of methane as one of the reactants for producing sodium metal, the other reactant of McGriff, unlike the invention, is preferably a molten sodium carbonate and further requires that carbon, in powdered form, be continuously passed into the reaction vessel. Further, unlike the invention, the McGriff '689 provides for burning of methane forming, as a product of combustion, water and carbon dioxide, with the water and carbon dioxide then prohibited from entering into a reaction of methane or carbon and with sodium carbonate reduced to produce sodium metal. The process of the McGriff '689 patent requires high heat with methane fed into very hot sodium carbonate and further requires that sodium carbonate be continuously added. This system not only requires a greater heat than which is required in the invention to produce the required reactions, it also requires an addition of solid coke in powdered form to provide the carbon required for the reaction to proceed. Unlike the system and process of the McGriff '689 patent, the present invention utilizes methane reductant with sodium hydroxide, that can be and preferably is an industry waste, does not reduce sodium carbon that serves only to provide heat as would require that carbon be added to perpetuate the reaction, is practiced as a continuous process and with the system shut down, provides an ease of access into the reactor vessel for performing maintenance tasks. Further the McGriff '689 patent does not deal with problems as are inherent in quenching vaporized sodium from a mix of gaseous carbon monoxide (CO) and sodium (Na), in that it fails to recognize and deal with a back reaction as will occur as the gases cool, with sodium tending to react with carbon monoxide, to produce sodium carbonate (Na2CO3), which problem the present invention addresses and solves.

A U.S. Patent to Deyrup, et al. U.S. Pat. No. 2,685,346, includes a step of quenching a hot vapor containing a free alkaline metal so as to condense that alkaline metal into a molten state, and deals peripherically with handling of a back reaction as the alkaline metal vapor is quenched, where carbon monoxide combines with the gaseous alkaline metal. Restricting such unwanted back reaction in Deyrup '346 is, however, very tedious and, unlike the system and steps of the invention, it involves an infusion of large amounts of tin and requires that the process take place, at a high temperature, and involves elaborate valves to handle such high temperature. Further, a to Deyrup et al., U.S. Pat. No. 2,685,346 teaches a multi-step process to provide for a quenching of the sodium metal from a vaporous mixture with carbon monoxide and hydrogen and is tedious in that, in its practice, it is likely that sodium will become entrained with nitrogen gas, thereby markedly reducing the sodium metal yield. Further, the system of the Deyrup, et al. '346 patent is not continuous.

Like the McGriff patent, an earlier to Bowe, U.S. Pat. No. 2,484,266, also involves a quenching step but does not, as does the present invention, handle to limit a resulting back reaction. Further the Bowe '266 patent utilizes iron in the form of ferro phosphorus into which alkali carbonates or hydroxides are introduced and is apparently practiced as a batch process only with that practice taking place in a vessel that is structurally very different from the reactor vessel and quench cooler of the present invention.

Other earlier processes and devices for producing sodium metal, and the like, utilizing metal vapor separation, include additional to the above cited to Deyrup, et al., U.S. Pat. No. 2,685,346, a later Deyrup, et al. U.S. Pat. No. 2,685, 505, that each set out a reactor vessel and process for practice therein that involves a distillation of a sodium or other alkali metal formed from a reduction of carbon with sodium compounds and with a separation of sodium from the mixture of sodium vapor and carbon monoxide resulting from a sodium carbonate reduction undertaken in the presence of molten tin. In both those patents, unlike the invention, the molten tin absorbs sodium metal out from the gas mixture with carbon monoxide passed unchanged therefrom, whereafter, the molten tin has absorbed sufficient sodium to form a sodium tin alloy that contains from one to seven percent by weight of sodium, the system must be shut down and the sodium tin alloy removed. Thereafter, the sodium metal is recovered from the molten tin alloy by exposing it to an inert gas, such as nitrogen, that removes the bulk of the sodium from the sodium alloy above the boiling point of sodium and with the resulting mixture of inert gas and sodium vapor then cooled to condense out liquid sodium metal that is in a substantially pure state. Both the Deyrup, et al. processes involve elaborate high temperature values and a multi-step quenching process to quench metallic sodium from the gaseous mix and, in practice, a large percentage of sodium will be entrained in the nitrogen gas. Unique therefrom, the reactor vessel and quench cooler and process for practice of the invention provide for condensation of liquid sodium metal directly out from a mix of gaseous carbon monoxide and hydrogen at less than atmospheric pressure, which less than atmospheric pressure reduces the presence of molecules as could contribute an unwanted back reaction. The process of the invention, unlike earlier processes, is simple and efficient and does not require a binding of the sodium with tin or any other metal. Further, carbon monoxide and hydrogen gas as is separated out from the gaseous mix when sodium is quenched is then useful for burning, along with added fuel, to produce heat in the reactor vessel that produces a heating of a sodium carbonate bath that transfers heat to the sodium hydroxide as it is drawn combined with a methane reductant. After quenching, the condensed sodium metal is available to be draw from the reactor system quench cooler, providing for a continuous sodium production.

SUMMARY OF THE INVENTION

It is a principal object of the present invention to provide a commercially practical apparatus and process for separating out sodium metal from a mixture of sodium hydroxide as a reactant and methane as a reductant heated by a sodium carbonate bath to above the vaporization temperature of sodium.

Another object of the present invention is to provide a reactor vessel and quench cooler and process for practice therein where sodium metal can be continuously produced from a reaction of sodium hydroxide as a reactant with methane as a reductant, directly heated by a molten sodium carbonate bath that is heated to vaporize and drive off vaporization sodium and gaseous carbon monoxide and hydrogen that is then rapidly quenched, condensing sodium metal from the other gaseous constitutes, and with that condensed sodium metal to be continuously drawn from the quench cooler of the reactor vessel system.

Another object of the present invention is to provide a reactor vessel quench cooler and process for continuous practice therein to produce, from a mix of sodium hydroxide as a reactant and methane as a reductant that is heated by a molten sodium carbonate bath to the vaporization temperature of sodium, with the gaseous mix then passed to the quench cooler wherein it is rapidly cooled, with sodium metal condensing out of the vapor and is drawn off, the process being practiced at less than atmospheric pressure in an inert atmosphere to avoid a back reaction as would diminish the amount of sodium metal as is produced, and with the off gas product of gaseous hydrogen and carbon monoxide available for mixing with additional fuel for burning to provide heat for the reactor vessel containing the molten sodium carbonate bath to vaporize the reactant and reductant mix.

Another object of the present invention is to provide, in a practice of the process of the invention, as a quenching step, a rapid cooling of the vaporized constituents at a less than atmospheric pressure, and in an inert atmosphere to limit collisions between molecules, to promote condensation of sodium metal while minimizing a back reaction.

Still another object of the present invention is to provide, as a quenching step, in a practice of the process of the invention a rapid cooling of the vaporized constituents in one embodiment, by directing the gaseous flow onto a cooled surface, and in another embodiment, by directing a counter current mineral oil spray into the gaseous flow.

Still another object of the present invention is to provide a reactor vessel and process for practice therein that is safe and economical for use in refining sodium metal from a mix of heated sodium hydroxide and methane, maintained in an inert atmosphere with the vaporization heat provided by a sodium carbonate bath to vaporize sodium metal, whereafter the gaseous constituents are quenched at less than atmospheric pressure, with, in that quenching sodium metal is rapidly condensed from the gaseous mix with minimum back reaction, and with the sodium metal liquid then drawn from the quench cooler, providing a continuous process.

Still another object of the present invention is to provide a reactor vessel and quench cooler for practice of an automated process to efficiently produce sodium metal that requires minimum human involvement to continually refine sodium metal from a mixture of heated sodium hydroxide and methane.

The reactor of the invention utilizes sodium hydroxide (NaOH) as a reactant combined with methane as a reductant that is heated by a sodium carbonate bath. The process includes heating the bath to a temperature between 1800 to 2000 degrees F., preferably utilizing a burner flame with the produced heat directed into the sodium carbonate bath maintained in the reactor vessel. The heat from the bath vaporizes sodium metal that combines with carbon monoxide and hydrogen gases with the gaseous mix passed through a constriction into a quench cooler. In the quench cooler the gaseous mix is rapidly cooled to condense sodium metal therefrom with carbon monoxide and hydrogen passed therefrom as off gases. The condensed sodium metal falls to the quench cooler vessel bottom and can then be drawn therefrom. The quenching process of the invention preferably takes place in a mostly inert atmosphere, at less than atmospheric pressure, thereby minimizing the number of free molecules as are present that could react with the sodium metal and produce sodium hydroxide as an unwanted back reaction product. In a practice of the process of the invention sodium metal is essentially continuously produced, with reactor vessel heat partially supplied by a burning of waste gases from the quench cooler including carbon monoxide and hydrogen that are mixed with a burning gas, such as methane, and burned.

BRIEF DESCRIPTION OF THE DRAWINGS

In the drawings that illustrate that which is presently regarded as the best mode for carrying out the invention.

DETAILED DESCRIPTION

Figure 1:
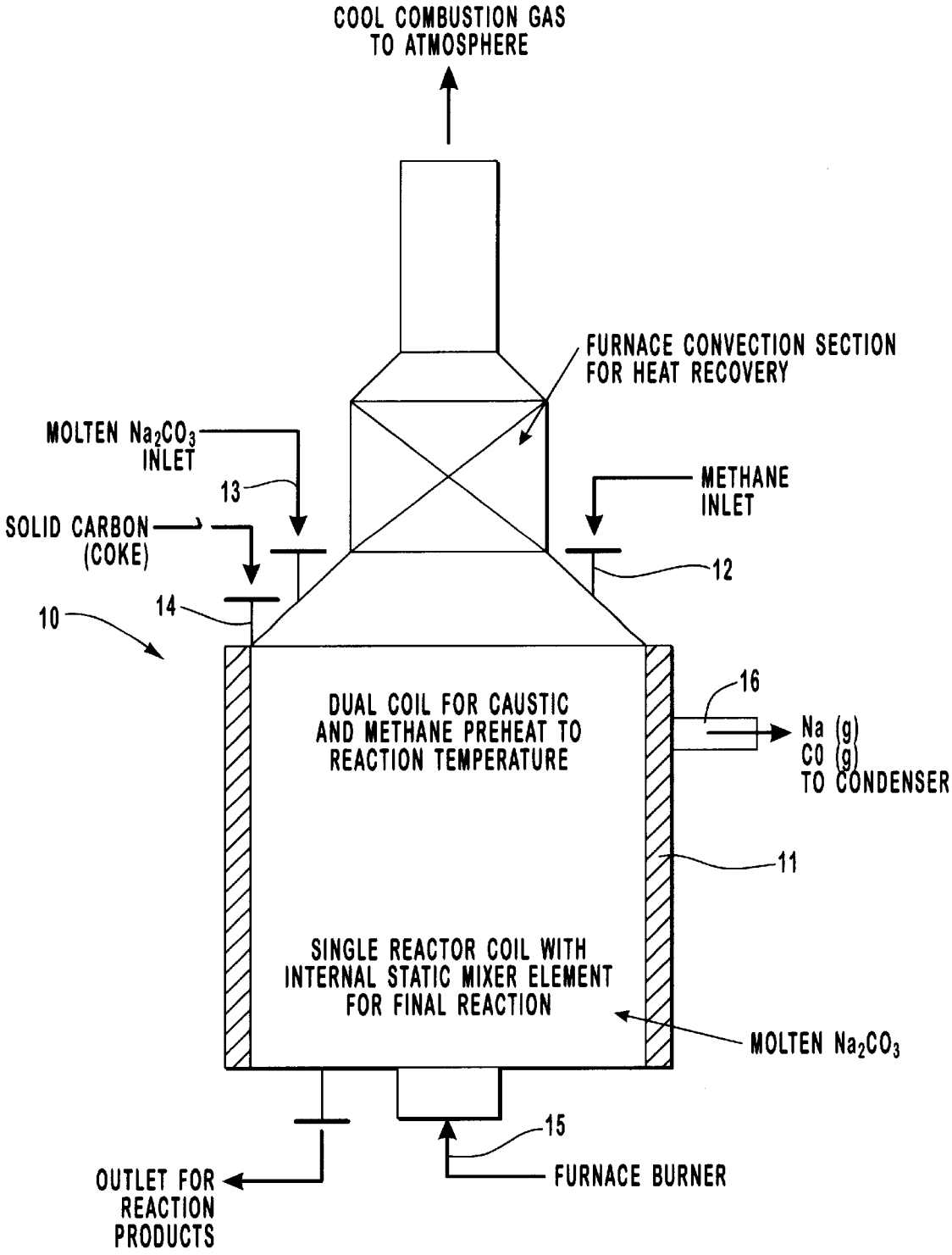
FIG. 1 (PRIOR ART)
FIG. 1 is a reactor vessel schematic identified as prior art illustrating an earlier apparatus for reacting heated sodium hydroxide and methane gas to produce sodium metal that the invention improves upon.

FIG. 1 shows a reactor vessel 10 identified as prior art that is an example of a prior system for refining sodium metal from a mix of sodium carbonate as a reactant with methane gas as a reductant and farther use methane with the sodium carbonate heated to a high processing temperature of from 1150 to 1240 degrees C. The vessel 10 of FIG. 1 is for practicing certain of the processing steps as set out in the U.S. Pat. No. 2,930,689 to McGriff to include a utilization of methane gas as a reductant and provides vaporized sodium metal from a heating of a sodium carbonate bath and includes movement of the vaporized gaseous mix to a condenser to condense out sodium metal for further processing. As shown, methane is passed through line 12 into reactor vessel 11 for burning in the system to refine sodium from sodium carbonate that is shown introduced into the reactor vessel through line 13. Further, a solid carbon, that is preferably powdered coke, is shown passed into the reactor vessel through line 14 to add needed carbon thereto, with the mix heated to a molten state as a bath of sodium carbonate by the operation or furnace burner 15. The mix is heated to the temperature, set out above, to vaporize sodium and to drive off carbon monoxide and hydrogen, with the mix then passed out from the reactor vessel 11 through line 16 to a condenser, not shown. The process is not indicated as taking place in an inert atmosphere as is the case with the invention, and in neither the McGriff '689 patent, nor any of the art cited above, teach a condensation like that of the invention or apparatus and step that takes place at less than atmospheric pressure, as is taught by the invention.

Further to the prior art, where, to provide for condensation of sodium metal out from a vaporized state, the U.S. Pat. No. 2,642,347 to Gilbert teaches directing vaporized sodium over steel balls, so as to rapidly cool the gas to condense sodium metal out from the gaseous mix, onto the ball surface wherefrom the sodium metal can be removed after system shut down. This process, of course, is a batch process only and requires that the system must be shut down to allow for removal of accumulated sodium metal and is accordingly unlike the present invention that is a continuous process.

The system of the Gilbert '347 patent could, of course, be utilized as the condenser of the McGriff '689 patent. Unlike such arrangement, however, the invention provides embodiments of quenching facilities that can be operated continuously, with sodium metal rapidly condensed from the vaporized mix and can then be drawn off Further, unlike the arrangement of FIG. 1, and the other cited prior art, the invention is practiced in an inert atmosphere with the mix of sodium metal vapor, with gaseous carbon monoxide and hydrogen, passed together to a quench cooler vessel through a constriction to speed up the gaseous flow, with quenching to precipitate sodium metal therefrom taking place at less than atmospheric pressure. Within the quench cooler fewer molecules are present at such reduced pressure as could react with, the liquid sodium thereby minimizing any unwanted back reaction where sodium metal could react to form sodium hydroxide. Provisions for prohibiting a back reaction are not found in any of the cited prior art, nor could any be assumed from a reasonable combination of that art.

Figure 2:
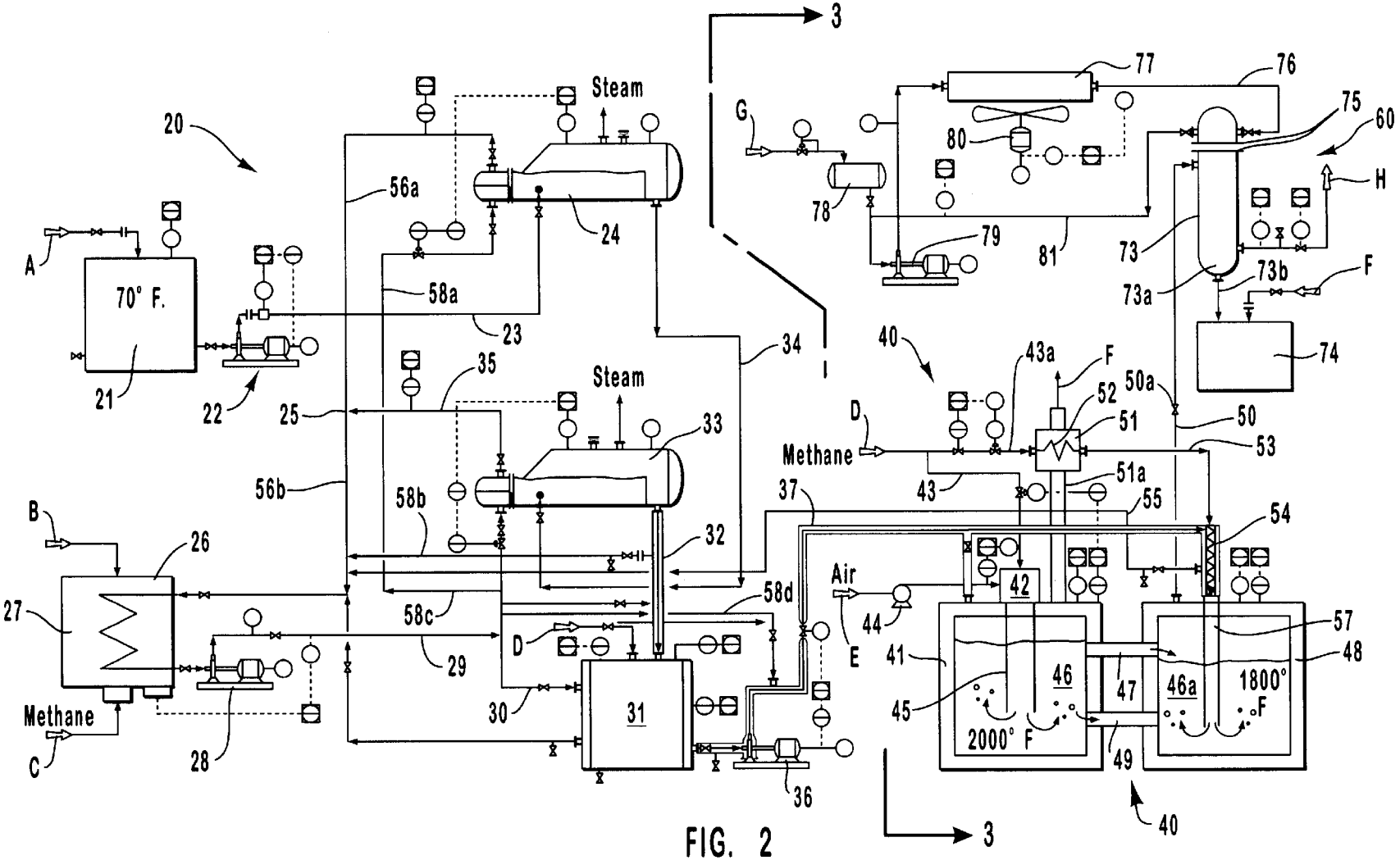
FIG. 2 is a plant schematic that includes the invention in a reactor system for extracting sodium metal from sodium hydroxide with methane gas as a reductant with the mix heated to a vaporous state in a sodium carbonate bath and includes a vapor quench cooler that is operated at less than atmospheric pressure to condense sodium metal out of the mix while minimizing a back reaction, and with the produced sodium metal drained from the quench cooler for further processing.

In FIG. 2 is shown a plant schematic 20 that includes the reactor system with a quench cooler to precipitate sodium metal from an output of gaseous sodium showing what is presently contemplated as a best mode for carrying out the invention. The system of plant schematic 20 preferably processes sodium hydroxide (NaOH) that may be waste from another chemical process or from any other source, and is recycled to produce sodium metal and with waste gas products produced from the system of the invention, shown as hydrogen and carbon monoxide gases passed to be added to and burned with a combustible fuel, shown as methane gas, that is burned to provide reactor vessel heating. Such sodium hydroxide waste is shown contained in tank 21 that, as shown by arrow A, receives sodium hydroxide at an ambient temperature. A pump 22 pumps the solution through line 23 into a first caustic concentrator 24 for removal of water therefrom, with a vent off of the condensed mix there passed through line 56*a* through a junction 25 as a thickened flow, to a mixing tank 26 that receives also a flow of an inert gas, shown here as arrow B and is identified as nitrogen, with methane passed also thereto, at arrow C as a dow therm oil that is a mixture of sodium hydroxide and methane that passes into a line 56*b*. The dow therm oil is heated to a temperature of approximately seven hundred degrees F., with such heating illustrated by a heat transfer coil 27, that is heated by the natural gas flame, though it should be understood, another appropriate heating arrangement such as an electric coil heater, or the like, could be so used within the scope of this disclosure. The heated dow therm oil is pumped by pump 28 through line 29 and through line 30 intersecting therewith into a molten caustic storage vessel 31. A flow is passed to the storage vessel 31 through an insulated line 32 to an overflow caustic concentrator 33 that also receives any overflow from the first caustic concentrator 24 through line 34 that intersects line 32 and, as needed, further removes water therefrom and passes a thickened flow through line 35 past junction 25 into line 56*a* from the first caustic concentrator 21 and which flow passes to the missing tank 26 back to the molten caustic storage vessel 31. So arranged, the dow therm is circulated and heated to maintain it in a fluid state.

Figure 3:
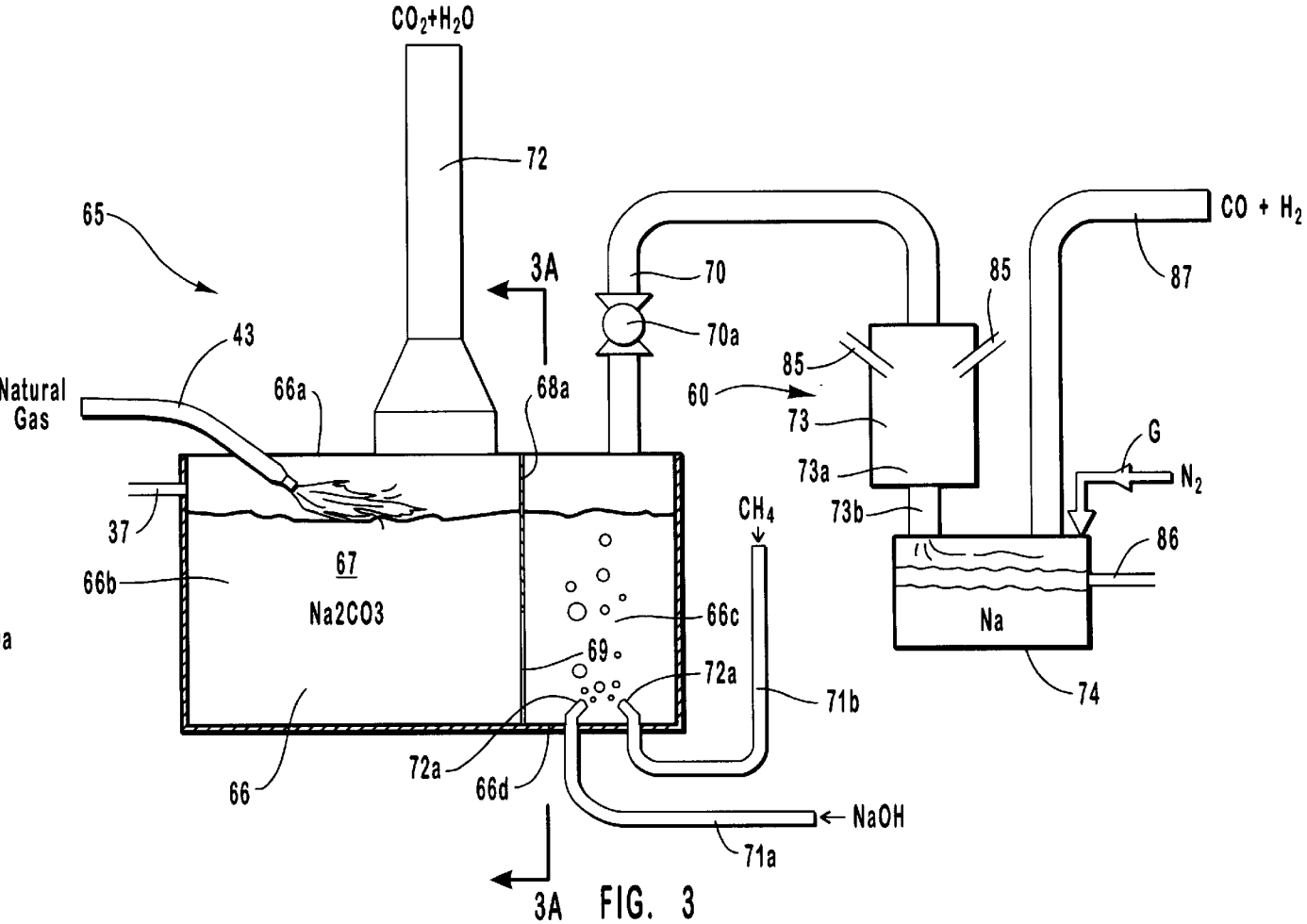
FIG. 3 is an enlarged view of the reaction vessel and quench cooler of the schematic of FIG. 2.

The molten caustic storage vessel 31, as set out above, contains the molten sodium hydroxide at a temperature of approximately seven hundred degrees F. that passed to a sodium extraction vessel 40 of the invention, as shown in FIGS. 2 and 3. The reactor vessel can be a pair of vessels, as shown in FIG. 2, or a single vessel as shown in FIG. 3, and is operated to vaporize sodium that, along with gaseous carbon monoxide and hydrogen is passed to a quench cooler 60, shown in FIG. 2 that is operated to condense sodium metal out of the gaseous mix that falls to and is collected in the bottom of the quenched vessel 73 and is drawn therefrom, providing a continuous process. The molten sodium carbonate bath is maintained at a temperature of approximately seven hundred degrees F. in the molten caustic storage vessel 31 and is pumped, by pump 36, through an insulated line 37 into a heating tank 48 of the reactor vessel 40, shown in FIG. 2. The temperature of the sodium carbonate bath in heating tank 41 is raised by operation of a burner system 42, to approximately two thousand degrees F. The burner system 42 preferably bums a mix of methane gas flow, shown at arrow D, that is passed through line 43 into the burner system and line 43*a*, and off gases of carbon monoxide and hydrogen from the quench cooler 60 as described below. The burner system also receiving a flow of air under pressure, shown at arrow E, pumped by a pump 44. The air and burning gas mix is passed into the sodium carbonate bath through open tubes 45, and that mix is ignited and burned therein so as to elevate and maintain the bath 46 at a temperature of approximately two thousand degrees F. In practice, the hotter bath 46 materials tend to circulate to the bath surface and are passed out of a conduit 47 into a secondary or vapor tank 48 that is maintained at approximately eighteen hundred degrees F., and colder sections of bath 46*a* in the secondary or vapor tank tend to circulate to the tank bottom area and are returned back through line 49 into the heating tank 41. With the bath 46 materials as are passed through line 47 to serve as a heat transfer agent.

To maintain the bath 46*a* temperature, as set out above, a flow of methane gas is provided for reaction through line 53 into the secondary or vapor tank 48. The secondary or vapor tank 48, like heating tank 41, receives the flow of methane gas for reacting, shown as arrow D, through line 43*a*, to a coil 52 that is located in a heat transfer manifold 51 wherethrough exhaust gases travel through stack 51*a* from the heating tank 41 and then through line 53. So arranged, the methane flow, entering as arrow D, is heated by the stack gases as have passed through heat transfer manifold 51 that are then vented, shown as arrow F, and the heated methane gas is passed through line 53 into a static mixer 54. In the static mixer 54 the heated methane is mixed with vent gases as have passed through line 55 that connects into vent off lines 56*a* and 56*b* from the respective first caustic concentrator 24 and overflow caustic concentrator 33. The methane and vent gases are mixed in the static mixer 54 that is preferably insulated, with the mixed methane and other gases than passed through open tube 57 into the secondary or vapor tank 48 for burning. The bath 46*a* temperature is thereby maintained at a temperature of approximately eighteen hundred degrees F. Further to the plant schematic 20, vent lines 58*a*, 58*b*, 58*c* and 58*d* are shown interconnecting the various vessels and lines to return a cool dow therm to dow therm heater 27 wherein that fluid is reheated.

The arrangement of the heating tank 41 and secondary or vapor tank 48 a first preferred embodiment of the reactor system or vessel 40 of the invention for vaporizing sodium and passing it and a gaseous mix of carbon monoxide and hydrogen off from the sodium carbonate bath 46*a*, with the vaporous mix to then travel through line 50 to the quench cooler 60. In practice, and as a best mode for practicing the invention, the quench cooler 60 is maintained at a less than ambient pressure at 0.3 atmospheres, with the gaseous sodium and carbon monoxide thereby tending to flow freely from a greater pressure found within the reactor system to a lesser pressure found in the quench cooler 60. The lesser pressure within the quench cooler further results in a presence of fewer free molecules as could react with the sodium metal as it condenses out of the vaporous mix, preventing an unwanted back reaction of the hot sodium metal forming sodium hydroxide. The functioning of which quench cooler 60 will be described in more detail hereinbelow.

Figure 3A:
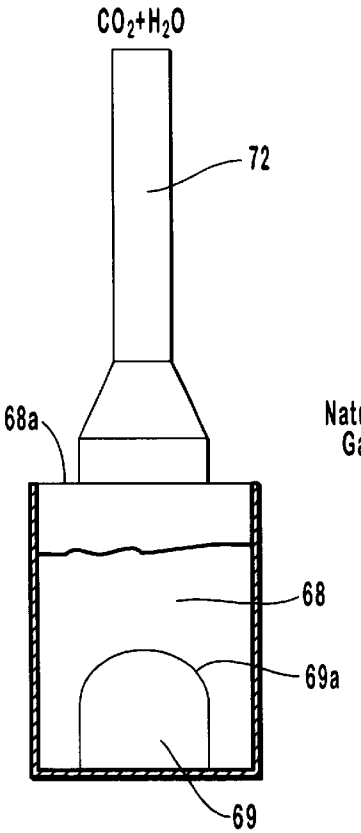
FIG. 3A is a cross sectional view taken within the line 3A—3A of FIG. 3, of the reactor vessel.

FIG. 3 shows another or second preferred embodiment of a sodium reaction vessel 65 of the invention. Shown therein, rather than the pair of vessels 45 and 48, shown in FIG. 2, the reaction vessel 65 is preferably a single tank or vessel 66 that receives a heated sodium carbonate dow therm oil bath 67 through line 37 of FIG. 2 and with methane gas, shown at arrow D, passed through line 37 for burning in vessel 65 to raise the bath 67 temperature to approximately two thousand degrees F. Where the sodium reaction vessel 40 of FIG. 2 includes the pair of vessels 41 and 48, with the vessel 48 venting a vaporous and gaseous mixture of sodium metal, carbon monoxide and hydrogen to the quench cooler 60, shown also in FIG. 2, the sodium reaction vessel 65 employs a dividing wall 68 that is secured across its top or upper end 68*a* to an inner surface of a top 66*a* of the tank 66 and extends down the tank 66 opposite sides. The dividing wall 68, as shown best in FIG. 3A, has an open lower mid or center section, shown to have an arcuate top wall 69*a* to provide an open section 69, extending upwardly from the wall bottom edge to a mid-section or portion thereof Circulation of the dow therm bath 67 through the arcuate section 69 is thereby allowed from a tank 66 burn end 66*b* into a tank 66 vent end 66*c* that is at a lower temperature of approximately nineteen hundred degrees F. The tank burn end 66*b* receives the gaseous mix of methane gas and air through line 43, with like the vessel 45, that is ignited and burned to raise the dow therm bath 67 temperature to approximately two thousand degrees F. The heated dow therm bath 67 provides a heat transfer to vaporize the mix of sodium hydroxide and methane that are passed into the reactor vessel 65 vent end 66*c* through lines 71*a* and 71*b*, and through nozzles 72*a* that direct the respective sodium hydroxide and methane flows together that impact and mix with one another to pass through and be vaporized in the dow therm bath 66*c*, and after vaporization is vented to the quench cooler 60, with the dow therm mix circulating into the tank end 66*c*. Like the vapor tank 48, vaporized sodium metal and carbon monoxide are vented from the tank vent end 66*c*, with the dow therm bath 67 constituents circulating along the tank 66 bottom 66*c* back into the heated burn end 66*b*. The gaseous sodium, carbon monoxide and hydrogen are vented off the top surface of the bath 67 at the tank vent end 66*c*, and may be exhausted through stack 72, or pass through line 70 to the quench cooler 60. In which passage, from both reactor vessels of FIGS. 2 and 3, the gaseous constituents pass through a constriction 50*a*, on line 50 in FIG. 2, and shown at 70*a* in broken lines in FIG. 3. Which constriction provides a reduction in the lines 50 and 70, respectively, cross section to decrease the pressure in the quench unit, as discussed below.

The quench cooler 60, as set out above, can be used with either of the described reactor vessels 40 and 65, and though it is here shown as two preferred embodiments or arrangements, with each embodiment or arrangement providing a best mode for practicing the invention, with each quench cooler to be connected to operate with either of the reactor vessels 40 and 65, and accordingly both the quench cooler embodiments of FIGS. 2 and 3 are identified with the same number. Preferably, for each embodiment, the quench cooler 60 includes a housing 73 that, as shown in FIGS. 2 and 3, can be cylindrical or other appropriate shape, and with each quench cooler embodiment to provide for a rapid cooling of the vaporized sodium with gaseous carbon monoxide and hydrogen to a temperature of from one hundred twenty (120) to three hundred fifty (350) degrees C. to condense sodium that will fall to the bottom 73*a* of the cylindrical housing and is passed therefrom into a sodium product holding tank 74 wherefrom the sodium metal can be drawn off for use. In each sodium product holding tank 74, an inert gas atmosphere is preferably maintained in the quench cooler 60 and sodium product holding talk 74 to limit back reaction, which atmosphere is shown as nitrogen gas, as indicated by arrow G with, it should be understood, the pressure in the quench cooler housing 73, as set out above, to be maintained at less than atmospheric pressure, and preferably in a range of pressure of from 0.2 atmospheres to 0.5 atmospheres.

In the embodiment of FIG. 2, the mix of vaporized sodium metal and carbon monoxide and hydrogen gases are quenched by a directing of the incoming flow against a cool surface, shown as a pair of plates 75, that preferably receive a refrigerant passed thereto through a line 76 from a refrigeration unit 77. Preferably, the refrigerant is dow therm coolant, shown passed as arrow G, that travels to a vessel 78 and is conveyed by pump 79 and travels into the refrigeration unit 77 that includes a fan 80 for removing heat off from a radiator wherethrough the coolant is passed, removing heat therefrom. The compressed coolant is then passed through line 76 into to cool plate 75. After cooling the plate 75 the coolant is returned through line 81 to vessel 78 for cooling and recompression. Contact of the vaporized sodium metal with plates 75 causes rapid cooling resulting in and condensation of sodium from a vapor state into a liquid form that then falls to the bottom of the quench cooler housing 73 and is passed through line 73*b* to the sodium product holding tank 74. During which quenching, off gas products as are produced that include carbon monoxide and hydrogen can be recycled, shown as arrow H, for supplementing the methane flow as is passed into the system for burning to heat the dow therm bath in the reactor vessels 40 or 65, as set out above.

FIG. 3 also shows the quench cooler 60 as having a cylindrical housing 73 and replaces the cooling plate 75 of FIG. 2, with quenching jets 85 that are directed into the vessel interior so as to spray a coolant, such as a cool mineral oil, or like appropriate non-reactive material, into the vaporized sodium metal to rapidly cool and condense out sodium metal that falls to the vessel bottom 73*a* and is drained through line 73*b* into the sodium product holding tank 74. With carbon monoxide and hydrogen gases remaining in a gaseous state after the sodium is condensed out tending to rapidly pass through and are vented from quench cooler 60, thereby limiting a potential for an unwanted back reaction with the liquid sodium metal.

The sodium product holding tank 74 is shown as including a drain pipe 86 that extends out from a top end of the tank to drain mineral oil therefrom as collects on the sodium metal surface and includes a gas vent pipe 87 that vents gases, such as carbon monoxide and hydrogen therefrom for recycling to serve as system burn gases, as set out above. In practice, the invention preferably utilizes methane or natural gas ($CH_4$) exclusively as a reductant and is preferably practiced utilizing sodium hydroxide only as a reactant that is preferably a waste product of another or other chemical reaction or reactions, with the formula for which reduction being:

$$CH_4+NaOH \rightarrow CO+Na+2.5\ H_2$$

To mininize a potential for unwanted back reaction, the embodiments of the quench cooler of the invention are each preferably operated at less than atmospheric pressure, preferably under a significant vacuum of from 0.2 to 0.5 atmospheres as compared to a pressure of approximately 1–2 atmospheres in the reactor vessel minimizing the number of free molecules as could enter into a back reaction with sodium metal. Further, a constriction is provided in the line from the reactor vessel to the quench cooler where the transfer line is reduced in area across the constriction or orifice to create the pressure drop in the quench cooler from the reactor vessel pressure. The pressure differential between the reactor vessel and quench cooler will cause the carbon monoxide and hydrogen gases to quickly pass through the quench cooler and are then routed or cycled back for burning, or the like, in the presence of a combustible gas, such as methane.

In the process, vaporous sodium and gaseous carbon monoxide and hydrogen, as are produced, leave the reactor vessel and enter a quench zone with the reaction to produce which vapor and gases taking place in the presence of an inert gas (preferably nitrogen). The gases that are present in the quench zone present a possibility of an unwanted back reaction with sodium after the sodium has been condensed out of the gaseous mix, which possibility is greatly reduced in a practice of the invention due to the large volume of hydrogen gas as is present in the quench chamber or vessel. The rapid movement of the gaseous hydrogen and carbon monoxide responsive to the presence of the constriction 50*a* in line 50 and 70*a* in line 70, and the operation of the quench cooler at low pressure, as set out above, minimizing the number of molecules as are present in the quench cooler as could react with the liquid sodium.

Where, as in the cited Gilbert '347 patent, a cold surface (steel balls) has heretofore been used to provide a surface whereto sodium is condensed from a vapor state, such use has been limited to a batch system only. The present invention, unique therefrom, provides a continuous process, employing, in one quench cooler embodiment, a surface that is maintained in a cool or cold state by passage of a refrigerant thereto, with condensed sodium to fall therefrom responsive to gravity, for collection and draining from the system, or, in another quench cooler embodiment, by providing for rapidly cooling sodium to condense it from the gaseous mix with carbon monoxide and hydrogen by an exposure of the gaseous mix to a cooling media, such as spray of a mineral or other dow thermal oil that is now reactive with sodium, to rapidly cool and condense sodium from a vapor to a liquid state, and then draining collected sodium from the quench cooler vessel and removing collected oil off from the sodium surface.

Hereinabove has been shown and described a preferred apparatus and system of my invention for producing sodium metal from sodium hydroxide reacted with methane in the presence of heat and by quenching or otherwise rapidly cooling a sodium vapor to condense sodium metal into a liquid that is then drawn off in a continuous process. It should, however, be understood that the present disclosure is made by way of example only and that variations are possible without departing from the subject matter coming within the scope of the following claims and a reasonable equivalency thereof, which subject matter I regard as my invention.

I claim:

1. A system for extracting sodium metal from a reaction of sodium hydroxide with methane gas comprising, a source of sodium hydroxide; a source of methane gas; a reactor vessel; line means for transferring and combining a flow of said sodium hydroxide with a flow of said methane gas and passing said into a molten sodium carbonate bath; means for transferring a flow of said molten sodium carbonate bath to said reactor vessel and means for maintaining an inert atmosphere in said reactor vessel; means for providing separate flows of sodium hydroxide and methane gas into said reactor vessel; a heating means arranged with said reactor vessel for heating said sodium carbonate bath to a temperature whereat sodium will vaporize and where carbon monoxide and hydrogen will become gaseous; means for transferring said vaporized sodium and carbon monoxide and hydrogen gases to a quench cooler means; a quench cooler means that contains an inert atmosphere at less than atmospheric pressure and includes a means for rapidly cooling said vaporized sodium and gases entering therein so as to condense sodium metal into a liquid to be collected and drawn from said reactor vessel; and means for venting said carbon monoxide and hydrogen from said reactor vessel.

2. The system as recited in claim 1, wherein the means for heating the sodium hydroxide is provided by burning methane gas in a closed vessel; and said closed vessel includes a dow therm bath of heating said sodium hydroxide and methane.

3. The system as recited in claim 1, wherein the means for transferring a flow of the molten sodium hydroxide to the reactor vessel is an insulated line wherethrough said caustic is pumped by a pump means.

4. The system as recited in claim 1, wherein the heating means includes a burner connected to receive a flow of air and methane gas under pressure and to pass that flow into the reactor vessel for ignition and burning therein, elevating the bath temperature to approximately two thousand degrees F.

5. A system as recited in claim 1, wherein the reactor vessel includes first and second sections that are at least partially separated and allow a flow from a, top area of the heated sodium carbonate bath to pass from said first section, that is maintained at approximately two thousand degrees F., to said second section and to provide a return flow from a bottom area of the heated sodium carbonate bath from said second section, that is maintained at approximately eighteen hundred degrees F., to said first section; means for recirculating said bath to said second section to vaporize sodium from the bath that combines with carbon monoxide and hydrogen gases passed from said bath; and the means for transferring said vaporous sodium and gaseous carbon monoxide and hydrogen to the quench cooler means in a vent line connecting into an upper portion of a quench cooler means vessel.

6. The system as recited in claim 5, wherein the vent line contains a constriction for reducing said vent line cross sectional area to reduce the pressure in the quench cooler.

7. The system as recited in claim 1, wherein the reactor vessel consists of first and second reactor vessel section that are separated by a dividing wall into separated compartments, which said dividing wall is open across a mid-section to a bottom thereof to allow for a free flow of the sodium carbonate bath between said first and second compartments.

8. The system as recited in claim 7, wherein the dividing wall is a flat section of a thin material that is suitable for exposure to high heat and includes the opening therethrough that is formed as an arcuate shaped opening that extends upwardly from a dividing wall bottom edge into a center portion of said flat section.

9. The system as recited in claim 1, wherein the quench cooler means is a closed vessel wherein an inert atmosphere is maintained at less than atmospheric pressure and has a vapor inlet whereto the means for transferring is connected to pass the vaporized sodium and gaseous carbon monoxide and hydrogen therein; means in said closed vessel for quickly cooling said vapor and gases entering said vessel to a temperature whereat liquid sodium condenses out of the vaporous and gaseous mix; drain means for draining said condensed liquid sodium from said vessel; and vent means for venting said gaseous carbon monoxide and hydrogen from said closed vessel.

10. The system as recited in claim 9, wherein the inert atmosphere is maintained in the quench cooler means closed vessel at a pressure of from 0.2 atmospheres to 0.5 atmospheres.

11. The system as recited in claim 9, wherein the means for quickly cooling vapor and gases entering quench cooler vessel is a plate means whereagainst said entering vapor and gases are directed; and cooling means for maintaining the temperature of the plate means surface whereagainst said entering vapor and gases are directed to a temperature that is less than the temperature at which sodium condenses into a liquid state.

12. A system as recited in claim 11, wherein a refrigerant is passed through the plate means to maintain the plate means surface temperature at from one hundred twenty (120) to three hundred fifty (350) degrees C.

13. The system as recited in claim 9, wherein the means for quickly cooling entering vapor and gases is at least one nozzle means that is mounted in the closed vessel to direct a flow therethrough into and countercurrent to the entering vapor and gases; a liquid coolant that is non-reactive with said vapor and gases; and means for passing said liquid coolant, under pressure, through said at least one nozzle means to spray into said entering vapor and gas flow, cooling said vapor to a temperature of from one hundred twenty (120) to three hundred fifty (350) degrees C., condensing sodium therefrom into a liquid.

14. The system as recited in claim 13, wherein at least a pair of nozzle means are mounted in the closed vessel so as to direct and spray a flow therethrough into and countercurrent to the entering gases that is a liquid having a specific gravity that is less than that of liquid sodium and is non-reactive therewith.

15. The system as recited in claim 14 wherein the liquid is a mineral oil.

16. The system as recited in claim 9, wherein the vent means is a line that connects from the quench cooler into the reactor vessel heating means for burning therein.

17. The system as recited in claim 1, wherein the means for providing separate flows of sodium hydroxide and methane gas into the reactor vessel are separate lines that vent into said reactor vessel through nozzles that direct said separate flows into one another.

* * * * *